US005180313A

United States Patent [19]

Brandt

[11] Patent Number: 5,180,313

[45] Date of Patent: Jan. 19, 1993

[54] GROUND CONNECTION FOR THE SPARK PLUGS OF A MULTI-CYLINDER INTERNAL-COMBUSTION VEHICLE ENGINE

[76] Inventor: Uwe Brandt, Bayernstrasse 33, D-5880 Lüdenscheid, Fed. Rep. of Germany

[21] Appl. No.: 799,703

[22] PCT Filed: Nov. 10, 1989

[86] PCT No.: PCT/DE89/00706

§ 371 Date: Sep. 7, 1990

§ 102(e) Date: Sep. 7, 1990

[87] PCT Pub. No.: WO90/07811

PCT Pub. Date: Jul. 12, 1990

Related U.S. Application Data

[63] Continuation of Ser. No. 576,401, Sep. 7, 1990, abandoned.

[30] Foreign Application Priority Data

Jan. 7, 1989 [DE] Fed. Rep. of Germany ..... 3900321

[51] Int. Cl.[5] ..... H01R 13/648

[52] U.S. Cl. ..... 439/125; 439/34; 123/169 R; 313/135

[58] Field of Search ..... 123/146.5 R, 169 R, 123/169 PA, 647; 313/135, 134, 118; 439/92, 125, 126, 127, 128, 34

[56] References Cited

U.S. PATENT DOCUMENTS

| | | | |
|---|---|---|---|
| 893,955 | 7/1908 | Van Woert | 313/135 |
| 1,413,142 | 4/1922 | Thayer | 313/135 |
| 1,596,685 | 8/1926 | Reardon | 313/135 |
| 1,818,884 | 8/1931 | Eckstein | 439/391 |
| 2,253,531 | 8/1941 | Pekis et al. | 315/85 |
| 2,409,732 | 10/1946 | Browne et al. | 123/169 |
| 2,768,227 | 10/1956 | Ruckelshang | 123/148 |
| 3,293,352 | 12/1966 | Livingston | 174/35 |
| 4,099,824 | 7/1978 | Schoppelrey | 439/505 |
| 4,465,331 | 8/1984 | Masuda et al. | 439/95 |

FOREIGN PATENT DOCUMENTS

| | | | |
|---|---|---|---|
| 2745061 | 4/1978 | Fed. Rep. of Germany . | |
| 3900321 | 5/1990 | Fed. Rep. of Germany . | |
| 1046902 | 12/1953 | France . | |
| 447580 | 4/1949 | Italy | 123/169 R |
| 324402 | 1/1930 | United Kingdom . | |
| 2016589 | 9/1979 | United Kingdom . | |

OTHER PUBLICATIONS

"Autoradio störungsfrei", (Interference-Free Automobile Radio) in Funkshau, No. 19, 1985, p. 48.

Anonymous, "Technische Unterrichtung/Funkenstörungen", (Technical Lessons/Radio Interference Suppression) BOSCH Publication, dated Sep. 30th, 1978.

*Primary Examiner*—Gary F. Paumen

*Attorney, Agent, or Firm*—Spencer, Frank & Schneider

[57] ABSTRACT

The invention relates to a plurality of spark plugs each being provided with an ancillary ground cable, the ancillary ground cables all being connected to the negative pole of a vehicle battery to provide an additional ground path.

6 Claims, 2 Drawing Sheets

GROUND CONNECTION FOR THE SPARK PLUGS OF A MULTI-CYLINDER INTERNAL-COMBUSTION VEHICLE ENGINE

This application is a continuation of application Ser. No. 07/576,401, filed Sep. 7th, 1990, now abandoned.

TECHNICAL FIELD

The invention relates to a ground connection for the spark plugs of a multi-cylinder internal-combustion vehicle engine, with the metal spark plug casing of each spark plug including a ground electrode and being screwed into a cylinder head of the engine. The engine is electrically connected with a vehicle ground and the vehicle ground is electrically connected with one pole of the vehicle battery.

PRIOR ART

Spark plugs are components of an ignition system for the internal-combustion engine of a vehicle. Each spark plug is composed of a metal center electrode which is embedded in a ceramic insulator. The lower portion of the insulator is received by a metal spark plug casing which includes a connecting thread for screwing the spark plug into a cylinder head of the engine. A second electrode, the ground electrode, is welded to the base of the spark plug. The ground electrode is connected with vehicle ground by way of the cylinder head of the engine.

The ground electrode has a fixed air gap from the center electrode, the electrode gap. High voltage ignition current coming from the distributor flows through the center electrode and bridges the electrode gap as a break-over ignition spark.

For appropriate engine performance, the spark must be strong enough to ignite the fuel mixture. This requires a relatively large electrode gap. However, the greater the electrode gap, the greater must also be the voltage required to produce the ignition spark.

SUMMARY OF THE INVENTION

It is the object of the invention to provide a ground connection with the aid of which ignition is improved. The invention is here based on the realization that it is not only important to increase the voltage. Rather, the invention is characterized in that, in order to improve ignition, an additional ground cable is provided for each spark plug. Each one of these cables is connected with the spark plug casing of the associated spark plug and the additional ground cables are connected with a common ground cable which is connected with the minus pole of the battery.

The following advantages are realized with the ground connection according to the invention: The generated spark is noticeably stronger. The engine starts better than an engine without an additional ground cable. It runs better while still cold; the engine does not buck. The engine reaches its operating temperature more quickly but does not get too hot. When hot, the engine runs quietly and powerfully. Vehicle pickup is better, independently of whether the engine is still cold or already warmed up. Engine performance on a hill is very good. Fuel consumption is less.—For one certain vehicle, the fuel consumption for short-distance driving dropped from 14 1/100 km to 11 1/100 km; for highway driving at a speed of 130 km/h, fuel consumption dropped from 9 1/km to 7.5 1/km. The stronger ignition spark results in fewer missed ignitions. The fuel is burnt more cleanly and more beneficial to the environment. Also, the spark plugs remain cleaner. Finally, the combustion chamber—pistons and valves—are also cleaner. Optimum engine tune-up with the aid of the additional ground cable results in results which are also considerable when the exhaust gases are examined separately.

Modifications and features of the invention are disclosed in the dependent claims.

BRIEF DESCRIPTION OF THE DRAWINGS

One embodiment of the invention is illustrated in the drawing FIGURES and will be described in greater detail below. It is shown in.

Figure 1:
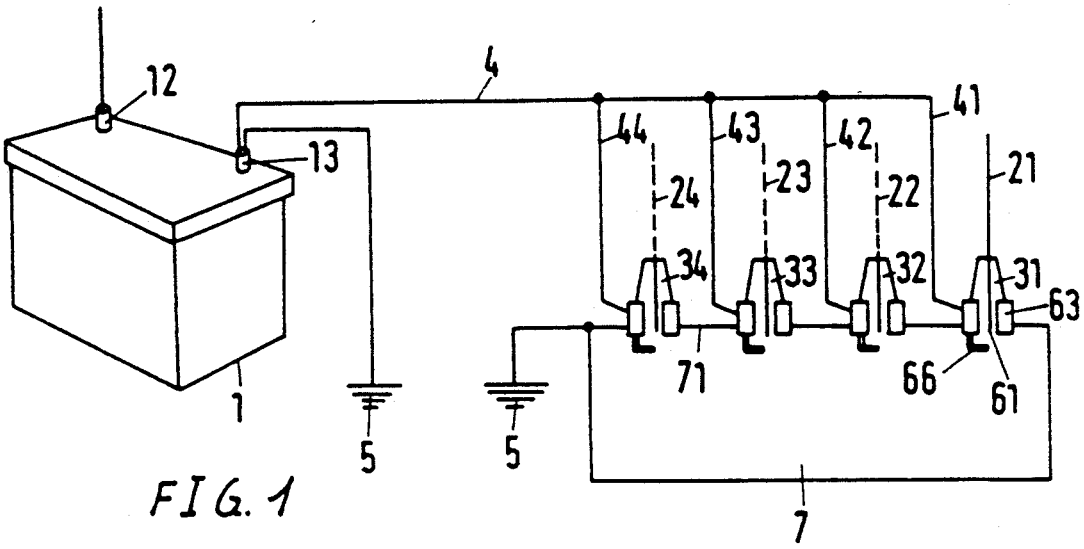
FIG. 1, a schematic circuit diagram.
Figure 2:
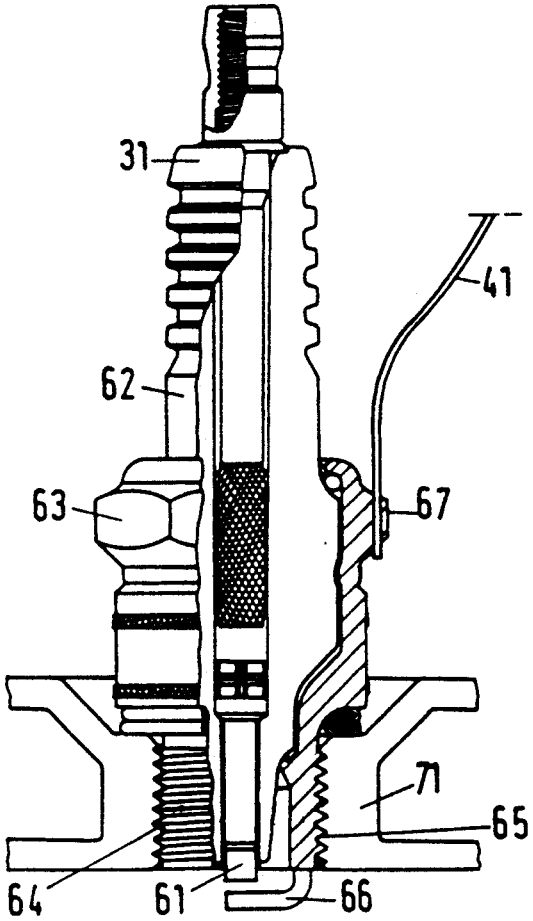
FIG. 2, a spark plug, partially in an axial sectional view, partially in a frontal view.
Figure 3:
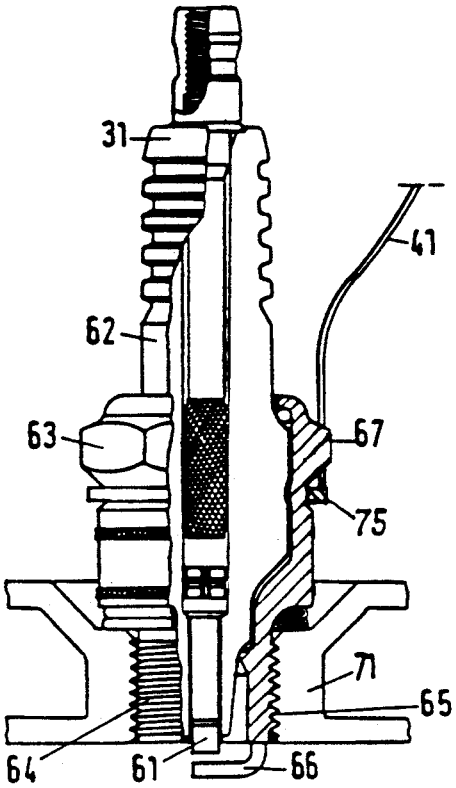
FIG. 3, a view similar to FIG. 2 of a further preferred embodiment, on a reduced scale.

The electrical circuit of a motor vehicle is fed from a battery 1. The positive pole 12 of this battery 1 is connected by way of an ignition lock—not shown—and an ignition coil connected with an ignition distributor. By way of the ignition distributor and with the aid of lines 21 to 24, a respective one of the—in this embodiment—four spark plugs 31 to 34 receives the ignition current. The solidly drawn line 21 supplies spark plug 31 with the ignition current. Lines 22 to 24, which lead to spark plugs 32 to 34, are without current. They carry the ignition current cyclically upon rotation of the ignition distributor.

The negative pole 13 of battery 1 is connected with vehicle ground 5, generally with the vehicle chassis. All other electrical devices of the motor vehicle are also connected with vehicle ground 5.

In the ground connection according to the invention, an additional ground cable 4 starts at the negative pole 13 of battery 1. Ancillary cables 41 to 44 are connected to this additional ground cable 4, each of which is connected with one of spark plugs 31 to 34.

Each spark plug 31 to 34 is composed of a center electrode 61, embedded in a ceramic insulator 62. The lower portion of ceramic insulator 62 is received by a metal spark plug casing 63. The metal spark plug casing 63 is equipped with a connecting thread 64 for screwing the spark plug into a cylinder head 71 of an engine 7. A second electrode, the ground electrode 66, is welded to the base 65 of the spark plug. It is connected with vehicle ground 5 by way of a cylinder head 71.

Figure 4:
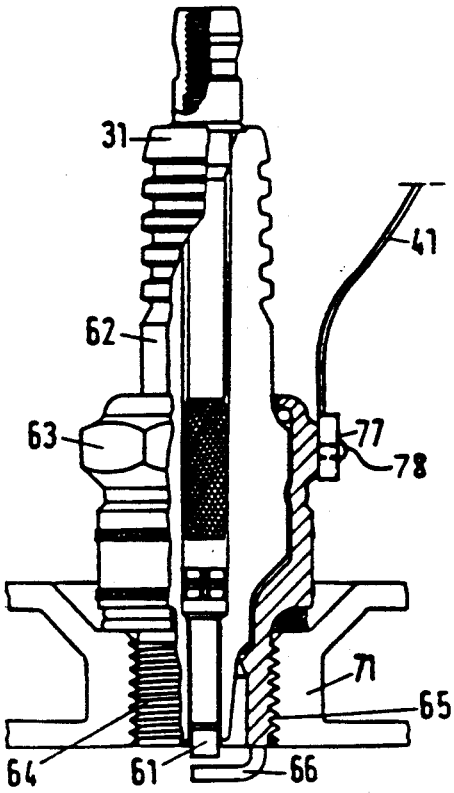
FIG. 4, a view similar to FIG. 3 of another preferred embodiment of the invention.

The ground cable 4, which is fastened at one end to the negative pole 13 of battery 1, is fastened to spark plug casing 63 by way of its ancillary cable 41. In the illustrated embodiment, a hole is drilled axially into spark plug casing 63, with the free end of ancillary cable 41 being inserted into this hole and welded on. Other types of fastening for ground cable 4 to spark plugs 31 to 34 are possible. For example, a ring 75 may be fastened to ground cable 4, 41 and placed around spark plug casing 63 as shown in FIG. 7. Or a clamping shoe 77 may be fastened to the end of ground cable 4, 41 so as to be screwed to the spark plug casing 63 by screw 78 as shown in FIG. 4. Further types of fastening for the ground cable, more precisely, the ends of ancillary cables 41 to 44, to the spark plugs 31 to 34 are possible.

The invention can be commercially utilized with all spark plugs which are components of a multi-cylinder internal-combustion vehicle engine.

I claim:

1. In a ground connection for spark plugs of a multi-cylinder, internal-combustion engine for a vehicle, in which each spark plug has a central electrode electrically connected to a positive pole of a vehicle battery and a metal spark plug casing, the metal spark plug casing of each spark plug including a ground electrode and being screwed into a cylinder head of the engine, the engine being electrically connected with a vehicle ground, and the vehicle ground being electrically connected with a negative pole of the vehicle battery, the improvement comprising:

a plurality of additional ground cables having first and second ends, each first end of the plurality of additional ground cables being electrically connected with the metal spark plug casing of a respective spark plug; and a common ground cable electrically connected with the negative pole of the vehicle battery and with each second end of the plurality of additional ground cables, whereby the ignition of the engine is improved.

2. A ground connection according to claim 1, further comprising a plurality of rings, each ring fastened to a respective additional ground cable and placed around a respective metal spark plug casing.

3. A ground connection according to claim 1, further comprising a plurality of clamping shoes, each clamping shoe fastened to the first end of a respective additional ground cable, and a plurality of screws for screwing a respective clamping shoe to a respective metal spark plug casing.

4. A ground connection according to claim 1, wherein each spark plug casing includes a bore, and wherein the first end of each additional ground cable is guided through the bore in a respective metal spark plug casing and is welded to the respective metal spark plug casing.

5. In combination, a multi-cylinder internal-combustion engine electrically grounded to one pole of a battery and having a plurality of spark plugs electrically grounded to said one pole and each including a metal spark plug casing, and an additional ground connection, said additional ground connection comprising:

a plurality of ancillary ground cables having first and second ends, each said ancillary ground cable having means at said first end electrically connecting said ancillary ground cable to said metal spark plug casing of a respective spark plug; and a ground cable having means electrically connecting said ground cable to said one pole of said battery, and said ground cable having means electrically connecting said ground cable with each second end of said plurality of ancillary ground cables.

6. A combination according to claim 5, wherein said one pole comprises a negative pole, and each spark plug comprises a central electrode electrically connected to the positive pole of said battery.

* * * * *